United States Patent [19]

Levesque

[11] 4,393,632

[45] Jul. 19, 1983

[54] BUILDING SYSTEM

[75] Inventor: Clarence N. Levesque, Westford, Mass.

[73] Assignee: C. Levesque Co. Inc., Lowell, Mass.

[21] Appl. No.: 228,336

[22] Filed: Jan. 26, 1981

[51] Int. Cl.[3] ..... E04H 1/00; E04B 2/88

[52] U.S. Cl. ..... 52/235; 52/206; 52/217; 52/508

[58] Field of Search ..... 52/235, 127.2, 509, 52/510, 508, 206, 217

[56] References Cited

U.S. PATENT DOCUMENTS

| | | | |
|---|---|---|---|
| 2,971,616 | 2/1961 | Bayley | 52/235 |
| 3,206,901 | 9/1965 | Bakke | 52/508 |
| 3,315,426 | 4/1967 | Rolland | 52/235 |
| 3,729,878 | 5/1973 | Termohlen | 52/235 |
| 3,936,986 | 2/1976 | Steel | 52/235 |
| 4,304,078 | 12/1981 | Meriwether | 52/127.2 |

FOREIGN PATENT DOCUMENTS

| | | | |
|---|---|---|---|
| 1296325 | 5/1969 | Fed. Rep. of Germany | 52/235 |
| 2315213 | 10/1973 | Fed. Rep. of Germany | 52/235 |
| 1573031 | 5/1929 | France | 52/235 |
| 1177674 | 4/1959 | France | 52/235 |
| 1404675 | 9/1975 | United Kingdom | 52/235 |

*Primary Examiner*—John E. Murtagh
*Assistant Examiner*—Henry E. Raduazo
*Attorney, Agent, or Firm*—Wolf, Greenfield & Sacks

[57] ABSTRACT

The system is for covering an existing building to finish particularly the exterior face of the building. Pre-fabricated panels with windows previously installed are secured within an existing window opening with the primary attachment for each panel being only at the window opening. Each panel comprises interconnected studs and bridging forming a frame having supported therein fiberglass insulation. Adjacent panels are sealed therebetween by a caulking bead. The panel is supported from the existing window opening by bracing at the top and sides.

15 Claims, 4 Drawing Figures

10A
67
16
46
14
20
62
64
12
30
48
36
32
38
50
53
52
44
42
54
55
40
26
62
64
22
24
64
62
26
56
58
60
34
28
14
32
30
28
16
67
30
46

BUILDING SYSTEM

BACKGROUND OF THE INVENTION

The present invention relates in general to a building system and pertains, more particularly, to a building system that comprises pre-fabricated panels secured within an existing window opening with the primary attachment for each panel being directly at the window opening.

The following U.S. Pat. Nos. pertain in general to building systems: 3,062,339; 3,251,168; 3,312,026; 3,316,681; 3,618,278; 3,672,107; 3,735,544; 3,805,465; 4,132,043; 3,194,333; 3,315,426. Most of the systems disclosed in these patents are adapted for new construction where the attachment is facilitated between the floor and ceiling. Thus, these systems are not readily adapted to use with an existing building wherein the purpose of the system is to cover the exterior face of the building in refurbishing the building. In other prior systems they do not provide for sufficient insulation and some of these systems are quite complex and adapted only for direct on-site fabrication.

One object of the present invention is to provide an improved building system and one which is particularly adapted for providing a covering for an existing building to provide a finish surface for the exterior face of the building.

Another object of the present invention is to provide a building system that comprises pre-fabricated panels.

A further object of the present invention is to provide an improved building system that comprises pre-fabricated panels having windows that can be previously installed at the fabricating plant.

Still another object of the present invention is to provide an improved building system including exterior pre-fabricated panels wherein the existing window opening is used to mount the panel. In accordance with the present invention the primary attachment for each panel is only at the window opening.

A further object of the present invention is to provide an improved building system which is characterized by improved insulation qualities.

Another object of the present invention is to provide an improved building system that is relatively simple in construction, that is structurally strong, and that can be pre-fabricated substantially entirely for direct installation at the existing building site.

SUMMARY OF THE INVENTION

To accomplish the foregoing and other objects of this invention, there is provided a building panel system adapted to be used as a covering for the exterior face of a building to be used in the refurbishing or restoration of the building. The building panel system of the present invention permits restoration of a building leaving intact the basic structural members of the old building with the outside surfaces being restored by covering with the building panel system of this invention. The system comprises a plurality of structural panels with each panel adapted for support from an existing window opening. Each panel comprises a rigid frame having a window opening, a window secured in the frame window opening, and means for securing the panel to the building including brace means extending from the rigid frame of the frame window opening to the building at the existing window opening. With the panels of this invention the existing building window opening is used as the primary area of support for each of the panels. In this way, the panel can be substantially totally pre-fabricated with little or no additional framing required such as the attachment of special braces or channels to support the panel. The window panel of this invention is particularly useful in a construction wherein the existing window has a height that is greater than the frame window opening. In such a construction the existing window opening is then covered by the window of the panel and also by a section of the frame which overlies the window. There is preferably also provided a brace that extends from the overlying section of the frame to the building. This brace may extend to the underside of an overlying floor such as a poured concrete floor typically employed in a building between floors. However, it is understood that the principles of this invention may also be applied to an arrangement wherein the existing window opening is not greater in height than the frame window opening. The means that are provided for securing the panel in the existing window opening preferably also includes means at the bottom of the panel window including a securing plate connected to the frame and secured to the structure of the building that defines the bottom of the existing window opening. Typically, the existing building is of concrete and the securing plate may be secured to the concrete at the edge defining the bottom of the existing window opening. Similarly, the overlying section of the frame, that overlies the window is also secured preferably by bolts to a building member defining the top of the existing window opening. This building member may also be of concrete, although, the panel may also be secured to an existing building construction of other type such as one employing metal supports. Also, in addition to the top and bottom means that are defined for securing the panel there is preferably also side supports connected to the sides of the window opening of the existing building. The frame is preferably constructed of metal studs interconnected by diagonal bridging. Within the frame there is preferably provided insulation such as fiberglass insulation. Also, a vapor barrier is preferably provided such as in the form of a polyethylene sheet. To provide integrity between adjacent panels in a vertical direction, there is provide a common support member interconnecting a top end of one panel and a bottom end of an adjacent overlying panel. This common support member is preferably coupled to the overlying support section of the frame. In this way the top section of the panel is supported at the existing window opening and this common support also supports the lower end of the overlying panel.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
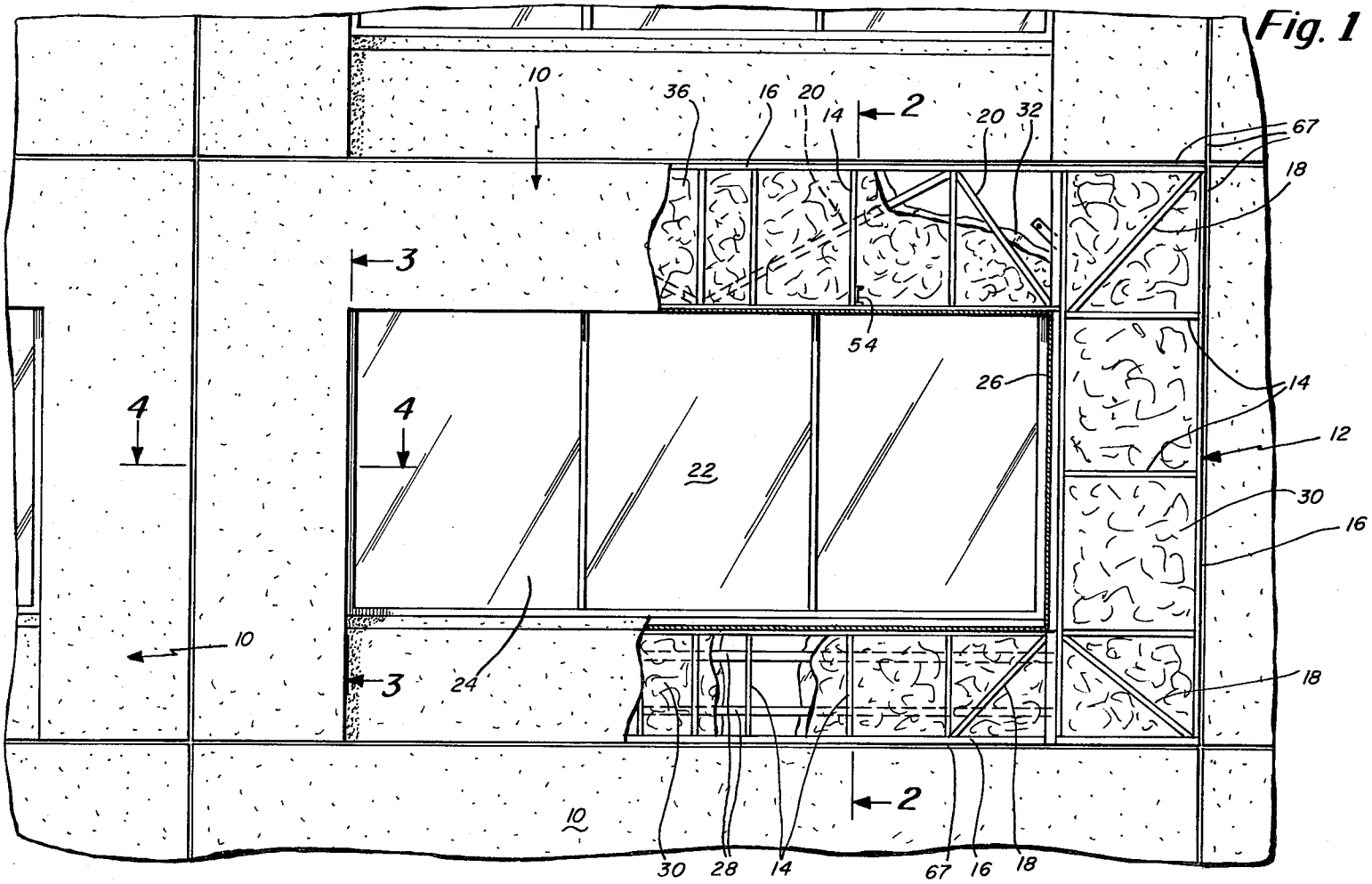
FIG. 1 is a front view, partially cut away, showing the preferred embodiment of the panel of this invention.
Figure 2:
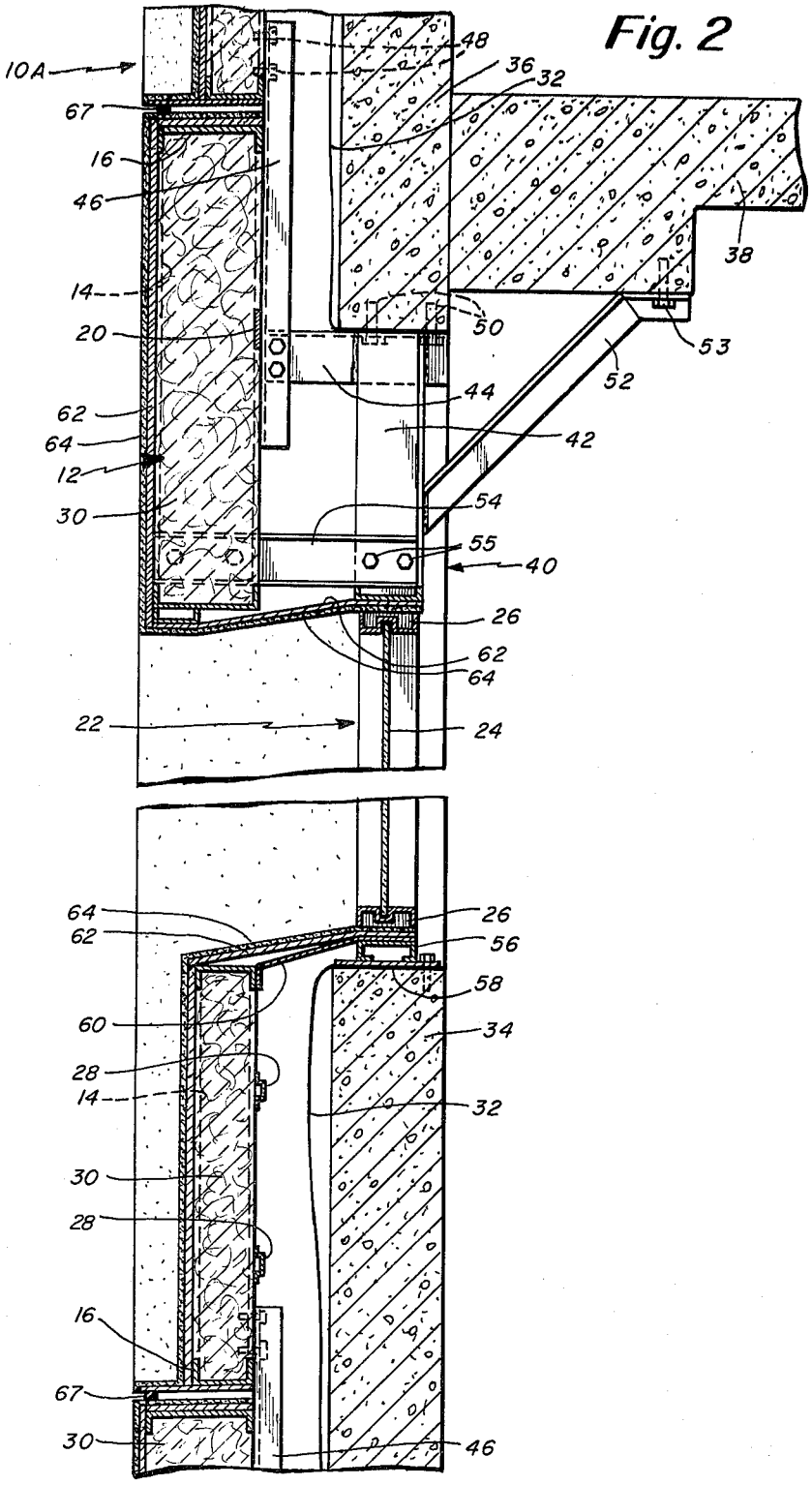
FIG. 2 is a cross-sectional view taken through the panel as taken along line 2—2 of FIG. 1 and showing the manner of attachment of the panel to the existing building.

FIGS. 1–4 show a preferred embodiment of the building panel system of the present invention. The particularl arrangement that is disclosed is adapted for use with a high rise type building such as an apartment house, although the principles of the invention may be applied to many different types of buildings. FIG. 1 shows a series of adjacently disposed panels 10. For the sake of simplicity, primarily only one single panel is described herein, although, connections are also shown between adjacent panels such as depicted in FIG. 2.

The panel 10 comprises a frame 12 which comprises a series of interconnected metal members. These members may be interconnected by welding. The structural members comprising the frame include studs 14, outer tracks 16, bridging 18 and face straps 20. The frame 12 has a centrally disposed opening for accommodating the window 22. This window is preferably a fixed sash window and the window may be of conventional design including glazing 24 and external frame 26. One of the features of the present invention is that the window 22 is readily installed in the window frame 26 at the plant where the panel is pre-fabricated. This makes for a more pre-fabricated system. Below the window 22 it is noted that there are also provided furring channels 28.

FIG. 1 also shows the use of insulation material 30 disposed within the frame. Associated with the insulation is a vapor barrier sheet 32 which may be a sheet of polyethylene.

In FIG. 1 there is shown primarily the rigid bracing that defines the basic frame construction. FIG. 2 shows greater detail of the external surfaces of the frame and also the means of attachment of the panels to the existing building. In this regard it is noted that the existing building includes concrete walls 34 and 36 along with floor 38. The walls 34 and 36 define an existing window opening 40. In the opening 40 is disposed the window 22 and an overlying section of the frame including frame member 42. There is a back brace 44 extending from the frame member 42 to the support channel 46. The channel 46 is a common support member. It is noted in FIG. 2 that channel 46 couples from the panel 10 at one location to a panel 10A disposed thereabove. The common support channel 46 may be secured to the panel frame such as by use of securing screws or bolts 48. The frame member 42 and the back brace 44 may be welded together and these two pieces may be secured by appropriate bolts or the like 50. In this way the frame is secured to the wall 36 of the existing building construction. Also, an additional brace 52 is preferably provided extending from the frame member 42 to the floor 38. Another bolt or the like 53 is shown for securing the brace 52 to the structural member 38. It is understood that the bracing shown in FIG. 2 may be repeated along the frame.

Also attached to the frame member 42 is another back brace 54 secured to the member 42 such as by bolts 55 or the like. The back brace 54 also extends forwardly and may attach to one of the upright studs comprising the base frame members.

At the lower end of the window 22 there is provided a metal stud 56 which may be secured to a bottom plate 58. The plate 58 is suitably secured to the top surface of the wall 34 defining the window opening 40. Between the stud 56 and the window frame 26 there is provided a support strip 60 sheathing 62, and finish 64. On the top section of the frame depicted in FIG. 2 there is also provided a sheathing 62 and a finish material 64. With regard to the top end of the window, it is noted that the frame 26 and the bottom of the frame member 42 have sandwiched therebetween the finish material 64 and the sheathing 62. The sheathing may be half inch exterior grade sheathing with the finish being a troweled exterior with a wire mesh base.

To provide a proper seal between panels a backer rope and/or caulking may be used as illustrated by the reference character 67 shown in FIG. 2.

Figure 3:
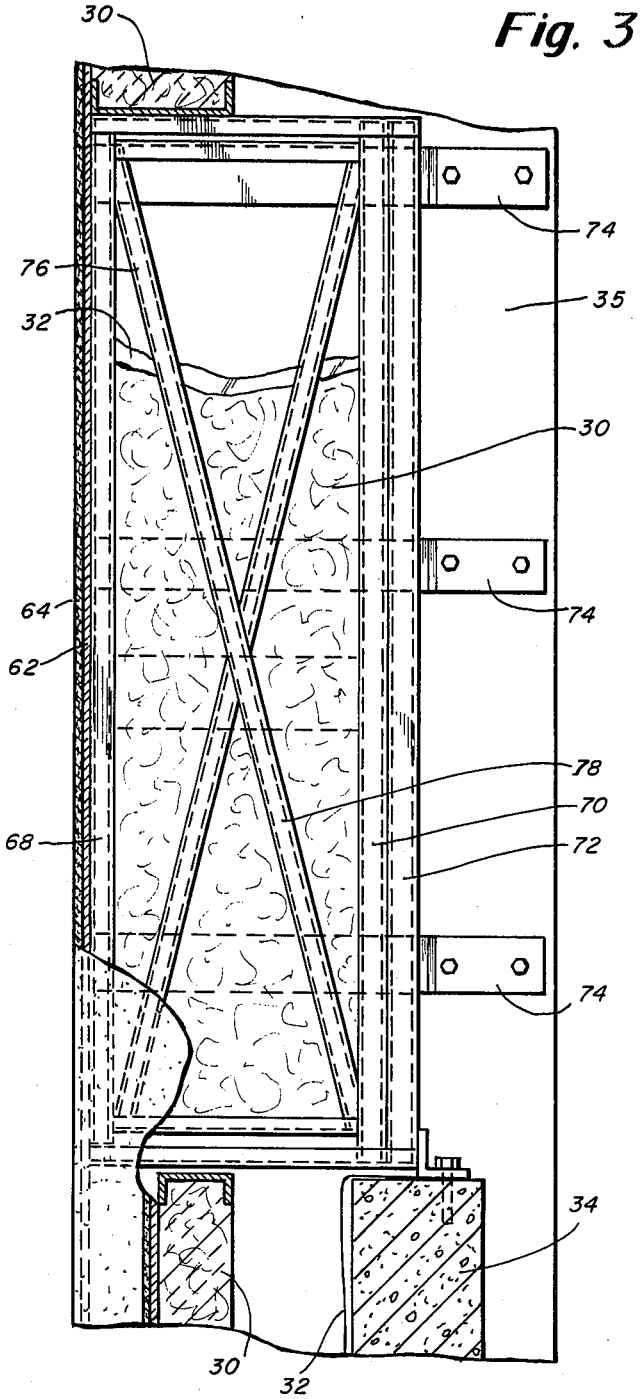
FIG. 3 is a cross-sectional view taken along line 3—3 of FIG. 1 showing the side construction and securing.

FIG. 3 illustrates the means for securing the panel frame at the sides of the window opening. This view is taken along line 3—3 of FIG. 1. The bottom support is at the existing wall 34. At the sides the frame comprises upright studs 68, 70 and 72. Tie braces 74 extend between these studs. The internal ends of these braces may be secured to the existing structural member 35. The external surface of the frame is as described previously including the sheathing 62 and the finish material 64. In addition to the studs 68, 70 and 72 there are also provided a pair of cross studs including a solid stud 76 and a notched or cut stud 78.

Figure 4:
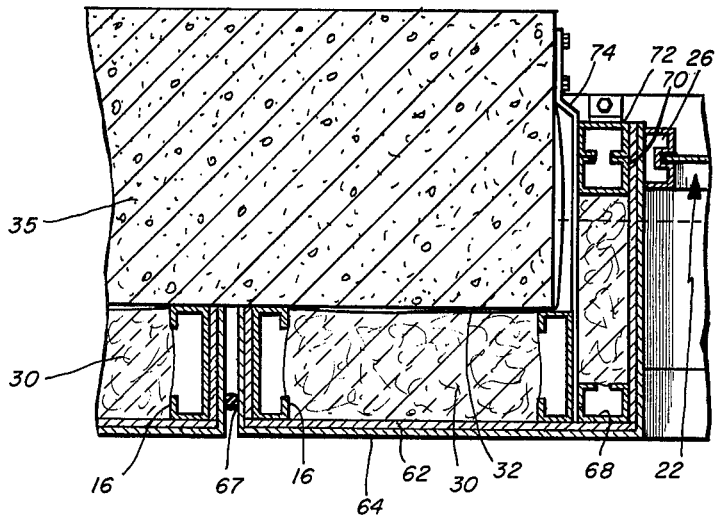
FIG. 4 is a cross-sectional view taken along line 4—4 of FIG. 1 showing further side support and the area of joining with an adjacent side panel.

FIG. 4 also shows details from an opposite cross-sectional view of the side construction.

Having described one preferred embodiment of the present invention, it is understood that other embodiments and modifications of the one described herein are contemplated as falling within the scope of this invention. For example, the panel system may be used with various forms of existing structure.

What is claimed is:

1. A building panel system for covering the exterior surface of a building that is being restored having a plurality of structural panels with each panel adapted for support from an existing window opening and comprising; a rigid frame having a window opening, a window secured in the frame window opening, and means for securing the panel to the building including brace means extending from the rigid frame above the frame window opening to the building at the existing window opening, said existing window opening being defined at least in part by upper and lower vertical support walls, wherein the existing window opening is greater in height than the frame window opening with the existing window opening being covered by the window and a section of the frame overlying the window, wherein the brace means comprises a brace extending from the section of the frame overlying the window to the upper vertical support wall of the building, wherein the means for securing also includes a securing member coupled to the rigid frame and secured to the top of the lower vertical support wall that in part defines the existing window opening.

2. A building panel system as set forth in claim 1 including securing bolts for fastening the overlying frame section to the bottom surface of the upper vertical support wall defining the top of the existing window opening.

3. A building panel system as set forth in claim 2 wherein the securing member includes a securing plate connected to the frame and secured to the upper surface of the lower vertical support wall of the existing window opening.

4. A building panel system as set forth in claim 1 including insulation means held in the frame.

5. A building panel system as set forth in claim 1 further including a common support member interconnecting a top end of one panel and a bottom end of an adjacent overlying panel.

6. A building panel system as set forth in claim 1 wherein the rigid frame comprises interconnected studs and bridging.

7. A building panel system as set forth in claim 1 wherein the means for securing also includes side support means connected to the building.

8. A building panel system as set forth in claim 1 including first and second fasteners, said first fastener for securing the brace to the bottom surface of the upper vertical support wall and the second fastener for securing the securing member to the upper surface of the lower vertical support wall.

9. A building panel system as set forth in claim 8 wherein the bottom surface of the upper vertical support wall is in facing relationship to the upper surface of the lower vertical support wall.

10. A building panel system as set forth in claim 9 wherein said window is substantially in the plane of the upper and lower vertical support walls.

11. A building panel system as set forth in claim 10 wherein each panel has an outer finish layer including a first finish layer extending from said brace and a second finish layer extending from said securing member.

12. A building panel system as set forth in claim 8 wherein said window is recessed inwardly from the rigid frame.

13. A building panel system as set forth in claim 1 wherein said window is recessed inwardly from the rigid frame.

14. A building panel system as set forth in claim 12 including means defining a window sill having said finish extend thereover.

15. A building panel system as set forth in claim 1 further including a diagonal brace associated with said aforementioned brace for securing the rigid frame to a horizontal wall of the existing building.

* * * * *